US011148305B2

(12) United States Patent
Folkersen et al.

(10) Patent No.: US 11,148,305 B2
(45) Date of Patent: Oct. 19, 2021

(54) SHINGLE CUTTING KNIFE BLADE

(71) Applicant: Roofers' Advantage Products, LLC, E. Wakefield, NH (US)

(72) Inventors: Jonny E. Folkersen, East Wakefield, NH (US); Benjamin J. Folkersen, East Wakefield, NH (US)

(73) Assignee: Roofers' Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 16/786,375

(22) Filed: Feb. 10, 2020

(65) Prior Publication Data

US 2020/0180173 A1 Jun. 11, 2020

Related U.S. Application Data

(63) Continuation-in-part of application No. 15/992,338, filed on May 30, 2018, now Pat. No. 10,562,197.

(60) Provisional application No. 62/514,485, filed on Jun. 2, 2017.

(51) Int. Cl.

| | |
|---|---|
| ***B26B 9/02*** | (2006.01) |
| ***B26B 5/00*** | (2006.01) |
| ***E04D 15/02*** | (2006.01) |

(52) U.S. Cl.

CPC ..... *B26B 9/02* (2013.01); *B26B 5/00* (2013.01); *E04D 15/02* (2013.01)

(58) Field of Classification Search

CPC .... B26B 9/00; B26B 9/02; B26B 5/00; E04D 15/02

USPC ..... D8/20; 30/346.55, 346.56, 353, 355

See application file for complete search history.

(56) References Cited

U.S. PATENT DOCUMENTS

| | | | | |
|---|---|---|---|---|
| 2,126,080 | A * | 8/1938 | Backer | A47J 17/02 30/353 |
| 5,720,105 | A | 2/1998 | Gates | |
| D493,340 | S | 7/2004 | Pyatt | |
| 6,895,674 | B2 | 5/2005 | Ai | |
| D605,005 | S | 12/2009 | Benson | |
| 8,099,871 | B2 | 1/2012 | Bilenski | |
| 10,442,093 | B2 * | 10/2019 | Jacobs | B26B 9/00 |
| 10,562,197 | B2 * | 2/2020 | Folkersen | B26D 1/0006 |
| 2007/0227012 | A1 * | 10/2007 | Constantine | B26B 5/001 30/162 |
| 2010/0293796 | A1 | 11/2010 | Votolato | |
| 2011/0094112 | A1 | 4/2011 | Patterson | |
| 2013/0167382 | A1 * | 7/2013 | Maras | B26B 5/005 30/353 |
| 2018/0194019 | A1 | 7/2018 | Knox | |

(Continued)

*Primary Examiner* — Hwei-Siu C Payer

(74) *Attorney, Agent, or Firm* — Maine Cernota & Rardin

(57) ABSTRACT

A novel cutting device useful for cutting asphalt shingles and other roofing products features a blade having a top edge, a bottom edge located on an opposite side of the blade relative to the top edge, and left and right edges; a lower cutting edge adjacent the left or right edge; an upper sharpened edge positioned above the lower cutting edge and adjacent the same edge as the lower cutting edge, wherein the upper sharpened edge and the lower cutting edge are configured for cutting; at least one inner edge emanating from the bottom edge and angled towards the top edge, wherein the inner edge is tangent to the upper sharpened edge; and at least on fin or nodule disposed between the lower cutting edge and the upper sharpened edge, wherein the bottom edge is parallel to and shorter than the top edge.

20 Claims, 7 Drawing Sheets

(56) References Cited

U.S. PATENT DOCUMENTS

| | | | | |
|---|---|---|---|---|
| 2018/0345508 | A1 | 12/2018 | Folkersen | |
| 2020/0180173 | A1* | 6/2020 | Folkersen | B26B 5/00 |

* cited by examiner

SHINGLE CUTTING KNIFE BLADE

RELATED APPLICATIONS

This application is a Continuation in Part of U.S. patent application Ser. No. 15/992,338, filed May 30, 2018, now U.S. Pat. No. 10,562,197, which claims the benefit of U.S. Provisional Application No. 62/514,485, filed Jun. 2, 2017. Each of these applications is herein incorporated by reference, in its entirety, for all purposes.

FIELD OF THE DISCLOSURE

The disclosure relates to cutting devices, and more particularly, to a cutting device for cutting shingles and other construction materials.

BACKGROUND OF THE DISCLOSURE

Typical asphalt shingles have granules embedded in an outward-facing side of the product. Among other benefits, the upper surface of shingles is granular to provide UV resistance, ensuring a long service life. The non-granular underside of most asphalt shingles, including field and starter shingles, consists essentially of an adhesive mass, which is typically embedded into a scrim or mat.

Asphalt shingles are often cut using a straight utility knife blade by scoring the non-granule side of the shingle. Another method of cutting asphalt shingles on the non-granule side is using a hook blade installed into a utility knife. This permits the roofer to cut the shingles at a single point of contact on the knife blade, with the roofer facing the granular shingle side. Hook blades are commonly used along rake edges when a shingle needs to be cut to length, such as when the shingle extends past a drip edge and into transitions, such as in a valley area.

The act of cutting shingles on the non-granular side, although preferred and often easier, is not always possible, sometimes due to job site requirements, or preferred. For example, many roofers cut their books of starter shingles with the granule side facing the roofer.

Furthermore, field shingles, to prevent seams of subsequent courses from lining up, which may cause leaks, are typically cut, starting from a corner of a roof, in a shape resembling a ladder. The ladder effect of field shingles coming off the rake requires approximately 90% of the field shingles be cut to length at the rake location. Because of this, the roofer is often forced to look at the exposed granular side of the shingle determine where to cut the shingle. Also, the prevalence of laminate, i.e. dimensional, shingles also can force the roofer to look at the exposed granular side of the shingle to determine where the shingle is not laminated, i.e. of single thickness, as standard hook blades struggle with cutting these shingles at the laminate, especially in colder weather. In such situations, it is typical for the roofer to cut the shingle on the granule-containing side.

The typical roofing hook blade, as shown in FIG. 1, fits into a utility knife and is approximately 0.025" thick 201, 2¼" long 202, and ¾" wide 203. Hook blades also typically comprise a means of engaging 204 a handle, to both allow the blade to be retained by and prevent the blade from disengaging from the handle during use. The base 205 leads to a flat angle 206 of approximately 45 degrees. The flat angle 206 continues for approximately ⅜" and becomes a sharpened edge 207, which continues to the point 208. The point 208 is typically in line with the base 205, as depicted by the imaginary line 209. The sharpened edge 207 is typically a semi-circle or continuous arch 210.

Where a roofer uses a typical hook blade, the flat angle 206 forces the roofer to hold the knife upright, reducing the force that can be easily applied to the roofing product, as the roofer must apply force to the knife to maintain this upright position while pulling on the knife in the direction of the cut tends to pull the knife away from this upright position. For at least this reason, the closer the utility knife is to the flat plane of the product being cut, the easier it is to pull the knife through the material. Also, when drawing the knife to apply maximum force, an upright position effectively shortens the hook on the blade, making it difficult to cut through laminate shingles in an ergonomic manner.

Additionally, a typical hook blade results in only a single point of contact 211 between the blade and the shingle, due to the limited way the knife must be drawn. This causes the blade to wear out quickly at the single point of contact 211, requiring frequent blade replacement, despite the majority of the blade retaining a sharp edge.

Furthermore, typical hook blades, due to their narrow point 208, are prone to breakage as the roofer applies lateral pressure when rotating the blade or cutting a shingle along an object, such as a drip edge.

Lastly, typical hook blades are problematic because there is no way to control how deep the blade cuts. Many products in the roofing industry come in roll form, including tar paper, synthetic underlayment, and self-adhered products and cover materials, such as, TPO, EPDM, and modified bitumen. The point 208 on a standard hook blade is prone to cutting the underlying rolled product, as there is no way to regulate the blade's depth with the product needing to be unrolled prior to cutting.

Therefore, what is needed is a blade configured to cut a roofing shingle from the underside, using more than one point of contact on the blade, and that can withstand lateral forces encountered during roofing-related cutting without breakage that also incorporates a means of limiting the depth of cut.

SUMMARY OF THE DISCLOSURE

One embodiment of the present disclosure provides a blade, the blade comprising: a first edge, a second edge, a third edge located on an opposite side of the blade relative to the second edge, and a fourth edge located on an opposite side of the blade relative to the first edge, wherein the fourth edge is substantially shorter than the first edge and is positioned such that its edges are substantially equidistant from the edges of the first edge; a substantially circular edge having a proximal portion adjacent the second edge and a distal portion approximately opposite the proximal portion, wherein the circular edge is a sharpened edge configured for cutting; at least one inner edge emanating from the nearest edge of the fourth edge and angled towards the first edge, wherein the inner edge is tangent to the distal portion of the circular edge; and at least one nodule disposed on the circular edge.

Another embodiment of the present disclosure provides such a blade further comprising a valley configured to capture an asphalt shingle positioned at the interface where the circular edge and nodule meet nearest the distal portion of the circular edge.

A further embodiment of the present disclosure provides such a wherein the blade is configured to be retained in a knife.

Yet another embodiment of the present disclosure provides such a blade wherein the knife is a utility knife.

A yet further embodiment of the present disclosure provides such a blade wherein the nodule is positioned substantially centrally on the circular edge.

Still another embodiment of the present disclosure provides such a blade wherein the nodule is positioned adjacent the proximal portion of the circular edge.

A still further embodiment of the present disclosure provides such a blade wherein the nodule comprises a flat portion configured to cut that is coplanar with the fourth edge.

Even another embodiment of the present disclosure provides such a blade wherein the proximal portion of the substantially circular edge terminates in a point.

An even further embodiment of the present disclosure provides such a blade wherein the blade comprises two a substantially circular edges, two inner edges and two nodules, the second of each being a mirror image of the first.

One embodiment of the present disclosure provides a knife, the knife comprising: a blade, the blade comprising: a first edge, a second edge, a third edge located on an opposite side of the blade relative to the second edge, and a fourth edge located on an opposite side of the blade relative to the first edge, wherein the fourth edge is substantially shorter than the first edge and is positioned such that its edges are substantially equidistant from the edges of the first edge; a substantially circular edge having a proximal portion adjacent the second edge and a distal portion approximately opposite the proximal portion, wherein the circular edge is a sharpened edge configured for cutting; at least one inner edge emanating from the nearest edge of the fourth edge and angled towards the first edge, wherein the inner edge is tangent to the distal portion of the circular edge; and at least one nodule disposed on the circular edge.

Another embodiment of the present disclosure provides such a knife further comprising a valley configured to capture an asphalt shingle positioned at the interface where the circular edge and nodule meet nearest the distal portion of the circular edge.

A further embodiment of the present disclosure provides such a knife wherein the blade is configured to be adjustably retained in the knife.

Yet another embodiment of the present disclosure provides such a knife wherein the knife is a utility knife.

A yet further embodiment of the present disclosure provides such a knife wherein the nodule is positioned substantially centrally on the circular edge.

Still another embodiment of the present disclosure provides such a knife wherein the nodule is positioned adjacent the proximal portion of the circular edge.

A still further embodiment of the present disclosure provides such a knife wherein the nodule comprises a flat portion configured to cut that is coplanar with the fourth edge.

Even another embodiment of the present disclosure provides such a knife wherein the proximal portion of the substantially circular edge terminates in a point.

An even further embodiment of the present disclosure provides such a knife wherein the blade comprises two a substantially circular edges, two inner edges and two nodules, the second of each being a mirror image of the first.

A still even another embodiment of the present disclosure provides such a knife wherein the blade is removable.

A still even further embodiment of the present disclosure provides such a knife wherein the first edge of the blade comprises two u-shaped apertures configured to allow the blade to be retained by a standard utility knife, each aperture being equidistant from a closest, opposite edge adjacent the first edge.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

As a preliminary matter, a nodule 306, as used herein, is a bump having a sharpened edge. In embodiments described herein, the nodule 306 protrudes from the sharpened edge of a hook blade and is configured to capture a relatively thin material between the sharpened edge thereof and the sharpened edge of the hook blade, allowing simultaneous cutting of both a top and bottom face thereof while limiting the depth of a given cut.

A nodule and various embodiments of the same, decreases the draw force required when cutting a roofing shingle. Further curvature may be added to the nodule, further exposing a shingle's underside to a sharp cutting edge. A curl in embodiments of the blade also assists in cutting, by causing a shingle to roll itself around the curl (more so during temperature increases), driving the underside of the shingle into the additional cutting face created by the curvature in the blade. The underside of the shingle, as it rotates around the nodule and curvature, becomes the top side of the shingle. As such, the top of the shingle rolls, and the underside becomes further exposed to the cutting surface of the blade.

Additionally, the angle at which the utility knife can be drawn, in embodiments, is adjusted by removing material from the flat angle 206 to more closely reflect the flat plane of the shingle or product being cut. Currently, a roofer must hold the knife upright due to the angle at which the flat angle 206 is manufactured. The modification of the flat angle increases the draw strength being applied directly to the shingle or product being cut.

Figure 1:
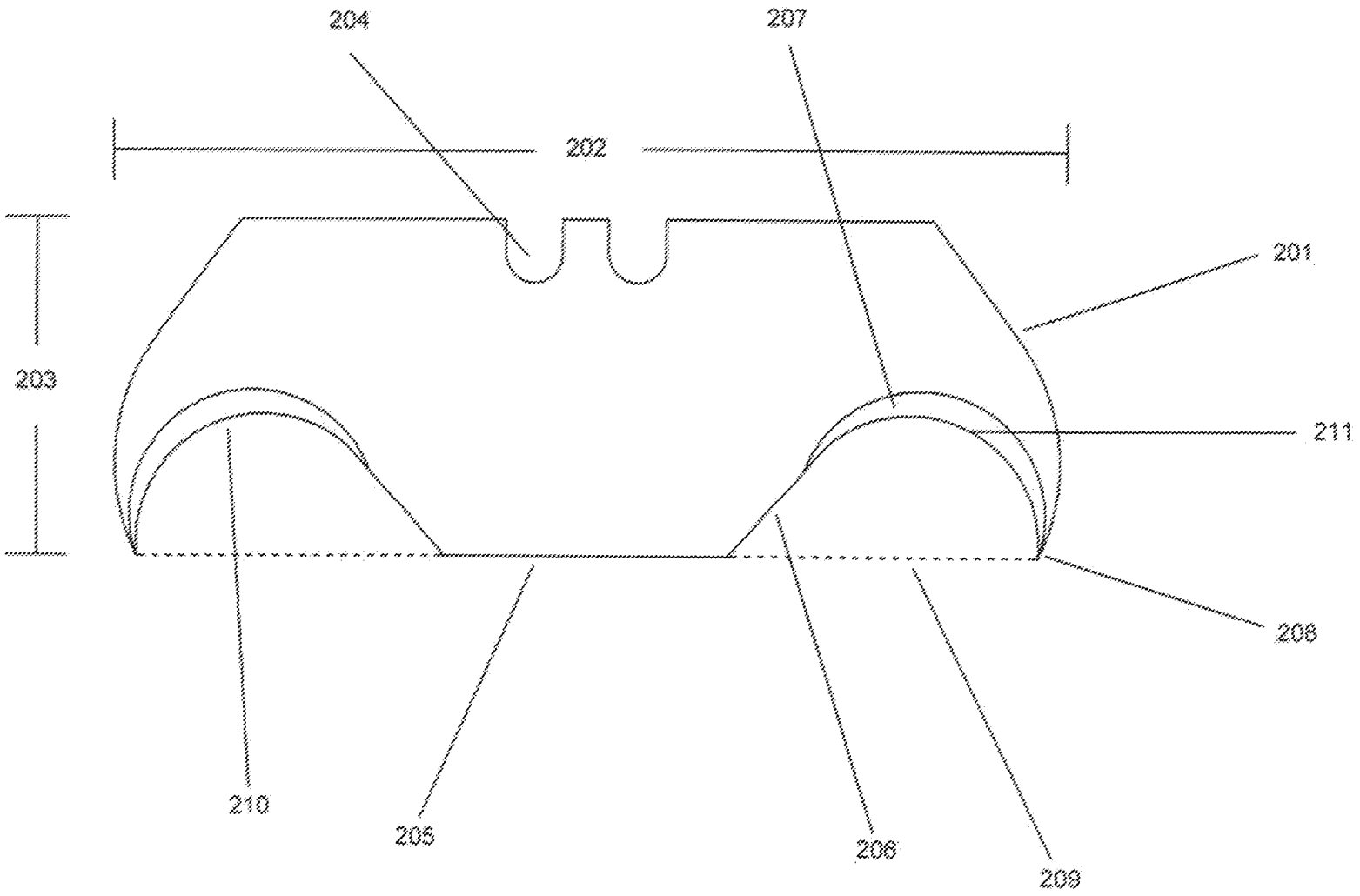
Figure 1 (Prior Art)
FIG. 1 is a line drawing illustrating a prior art hook blade.
Figure 2:
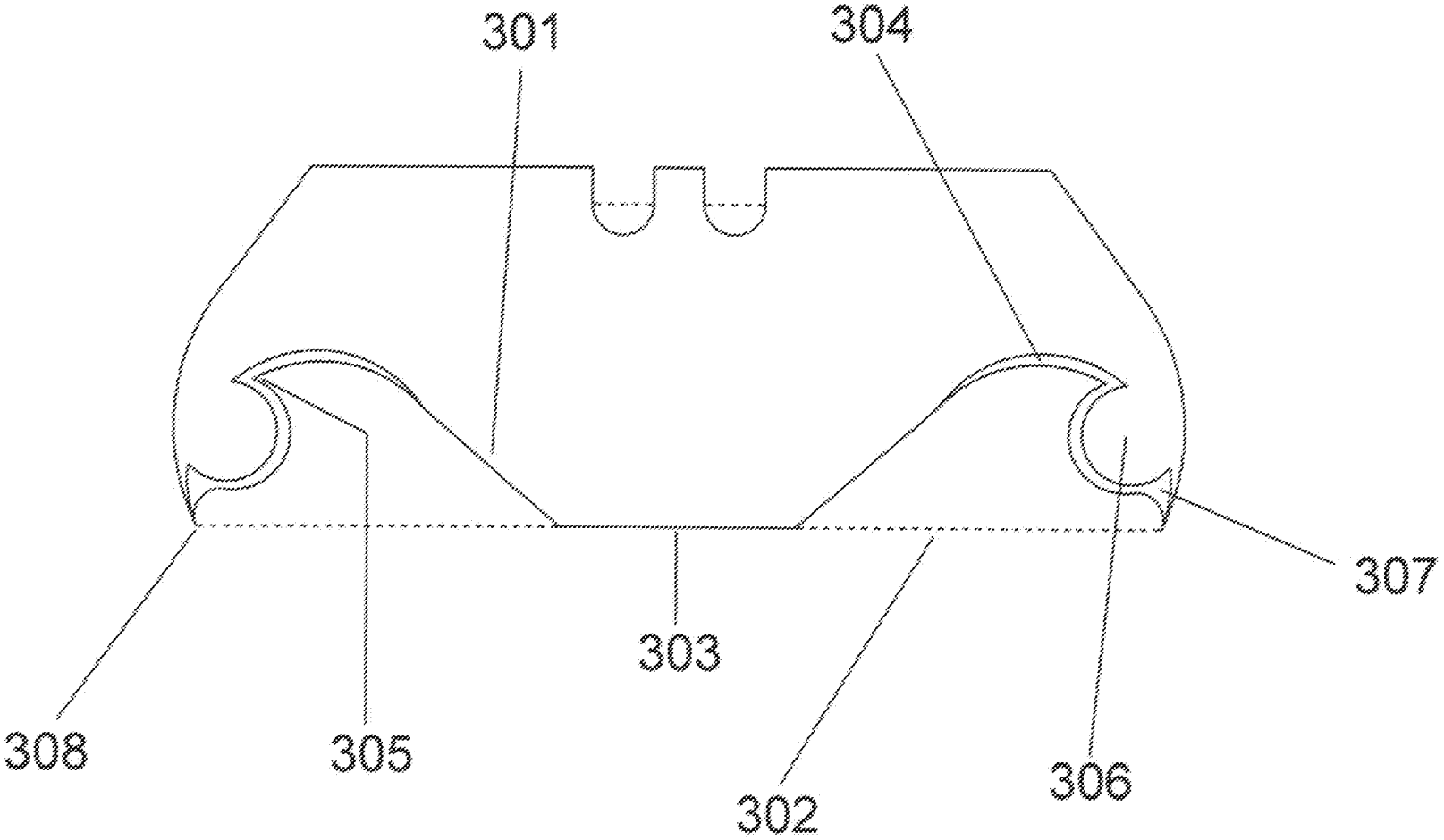
FIG. 2 is a line drawing illustrating a hook blade with the addition of a nodule, which terminates in a point, in accordance with embodiments of the present disclosure.

The cutting of rolled products in a depth controlled manner is made possible by the point 308 and its physical position relative to the nodule 306, as depicted in FIG. 2. These products for sloped roofing typically come in widths of 36" to 60". When commencing a cut on an underlayment while on the roof, it is often easier to start the cut in the field of the product due to maneuverability and reaching restrictions, hence the utility of a point 308. The same blade with the nodule 306 can be used to cut shingles without changing blades.

The increase in popularity of laminate or dimensional shingles with more than two laminates makes the design of a robust "roofing" version of the blade desirable. The manufacturing of a blade from a 1"-1½" wide material, as in various embodiments, allows the blade to accommodate a relatively thick shingles while providing for a larger nodule. In addition, a blade that is approximately ¼"-¾" wider strengthens the weakest part of the utility blade, making it less prone to breaking off while being subject to lateral pressure while maintaining the blades position.

Now referring to FIG. 2, FIG. 2 discloses a hook blade in accordance with embodiments of the present disclosure. From the base 303 of this hook blade, a straight line 301 extends diagonally, at an angle. This line 301 continues for a length and transitions to what is herein referred to as an upper sharpened edge 304, which in embodiments, comprises an arc with a radii incident on a midpoint thereof, if extended, that passes between an edge of base 303 and point 308, the upper sharpened edge 304 facing inwards, towards the base 303.

The upper sharpened edge 304 of embodiments further comprises a nodule 306. Due to the shape and placement of the nodule 306 on the hook blade, a valley 305 is created between the upper sharpened hook blade edge and the nodule. The valley 305 where the upper sharpened edge and the nodule intersect is herein referred to as the shear point 305.

More specifically, at the shear point 305 of embodiments, a nodule 306 extends outwards at an angle and continues, creating a bump. The nodule 306 of embodiments ends by connecting seamlessly with the lower cutting edge 307. The lower cutting edge 307 of embodiments continues in a slight crescent shape and terminates in a point 308. In embodiments, the point 308 terminates substantially on the imaginary line 302, which connects base 303 to points 308 of the hook blade.

Figure 3:
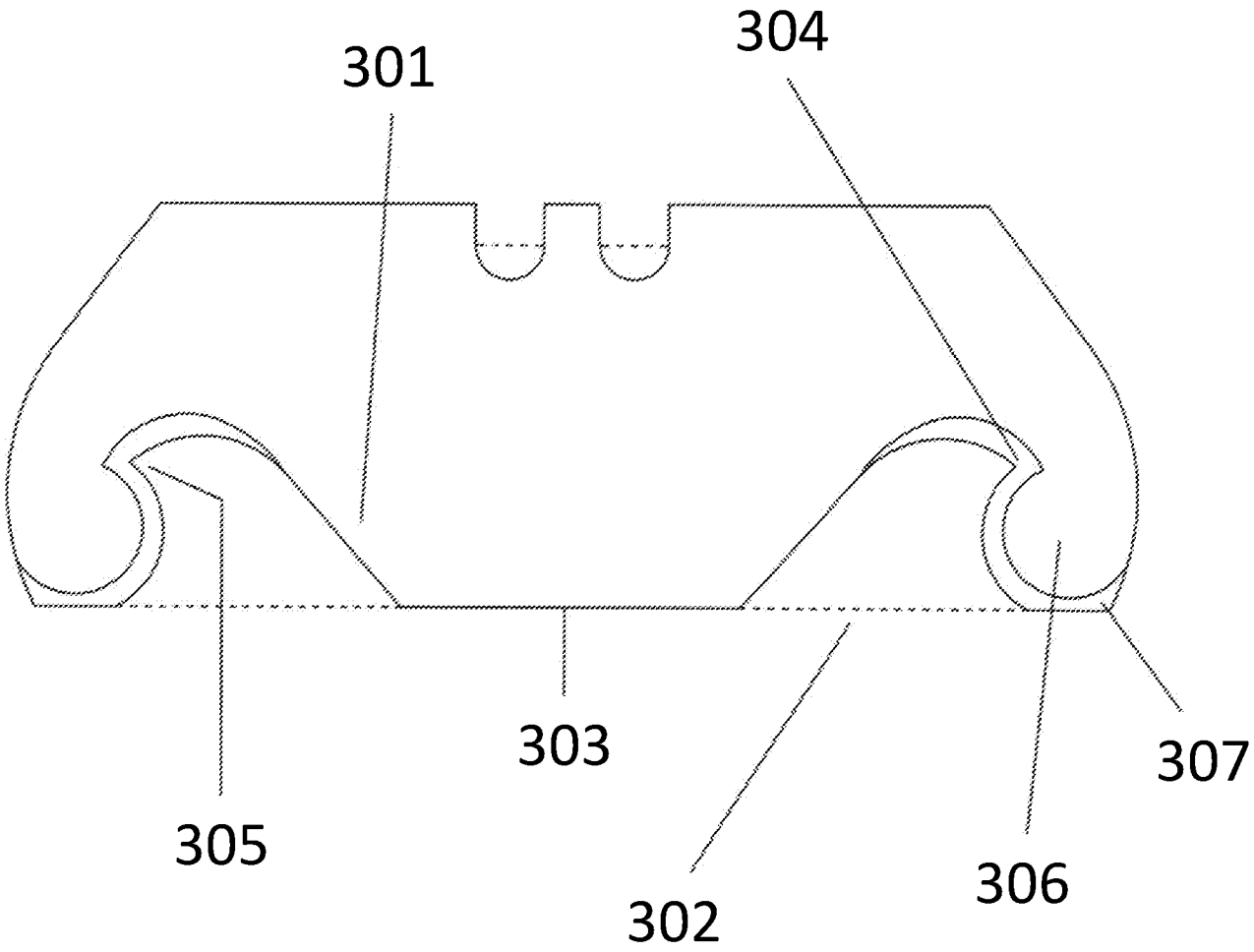
FIG. 3 is a line drawing illustrating hook blade with the addition of a nodule which becomes a lower cutting edge, in accordance with embodiments of the present disclosure.

Now referring to FIG. 3, FIG. 3 discloses a hook blade with a an inner edge 301, relative to the imaginary line 302, in accordance with embodiments of the present disclosure. The base 303 of such embodiments transitions into an inner edge 301. The inner edge 301 of embodiments continues for approximately ⅜" and becomes a sharpened edge 304, which smoothly transitions into a nodule 306, a sharpened outer portion of the nodule 306 protruding towards the imaginary line 302 and the inner edge 301, terminating in a flat lower cutting edge 307, with the surface of the lower cutting edge substantially coincident with the imaginary line 302.

Figure 4:
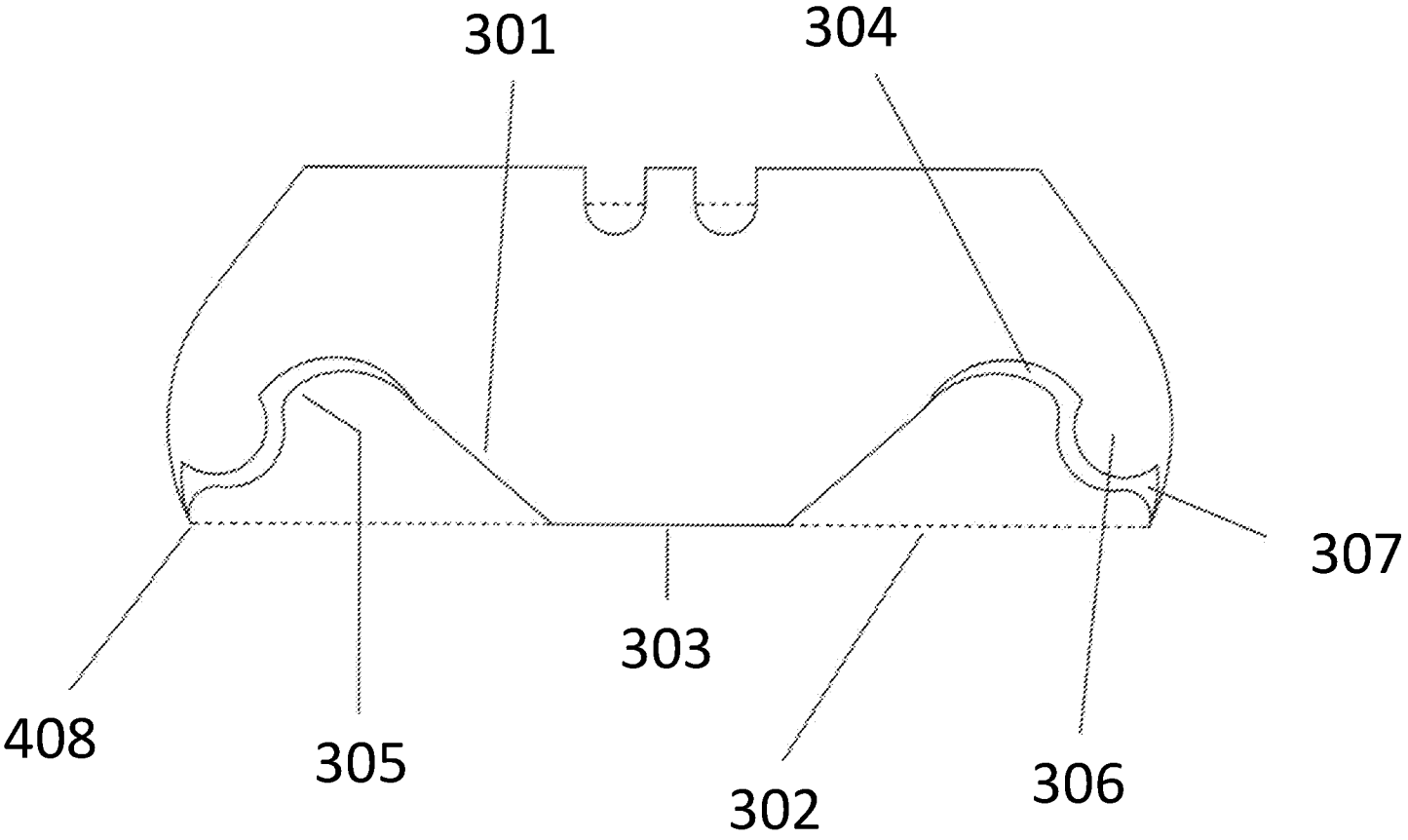
FIG. 4 is a line drawing illustrating hook blade with the addition of a nodule and curvature, which terminates in a point, in accordance with embodiments of the present disclosure.

Now referring to FIG. 4, FIG. 4 discloses a hook blade with an inner edge 301, relative to the imaginary line 302, in accordance with embodiments of the present disclosure. As in previous embodiments, the base 303 of such embodiments transitions into an inner edge 301. The inner edge 301 continues for approximately ⅜" and becomes a sharpened edge 304, which transitions to an arc 305. At a point along the arc 305, the arc 305 transitions into a nodule 306 that extends towards the imaginary line 302 and the inner edge 301, before transitioning into a lower cutting edge 307 that is incident on the original arc 305. The lower cutting edge 307 of embodiments ends in a point 408. The point 408 and the base 303 terminate substantially on the imaginary line 302.

Figure 5:
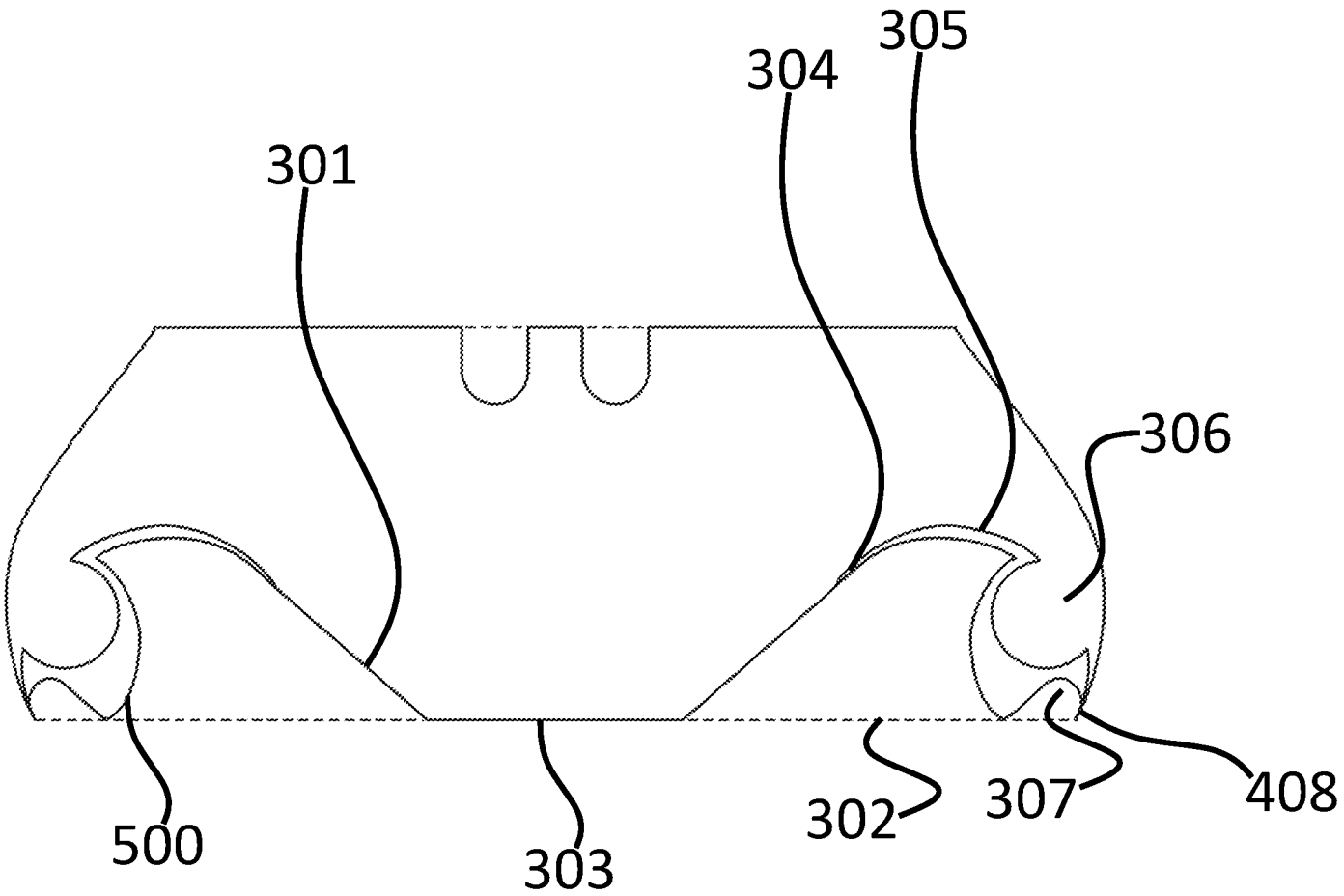
FIG. 5 is a line drawing illustrating hook blade with the addition of a nodule and curvature, which terminates in a point, in accordance with embodiments of the present disclosure.
Figure 6:
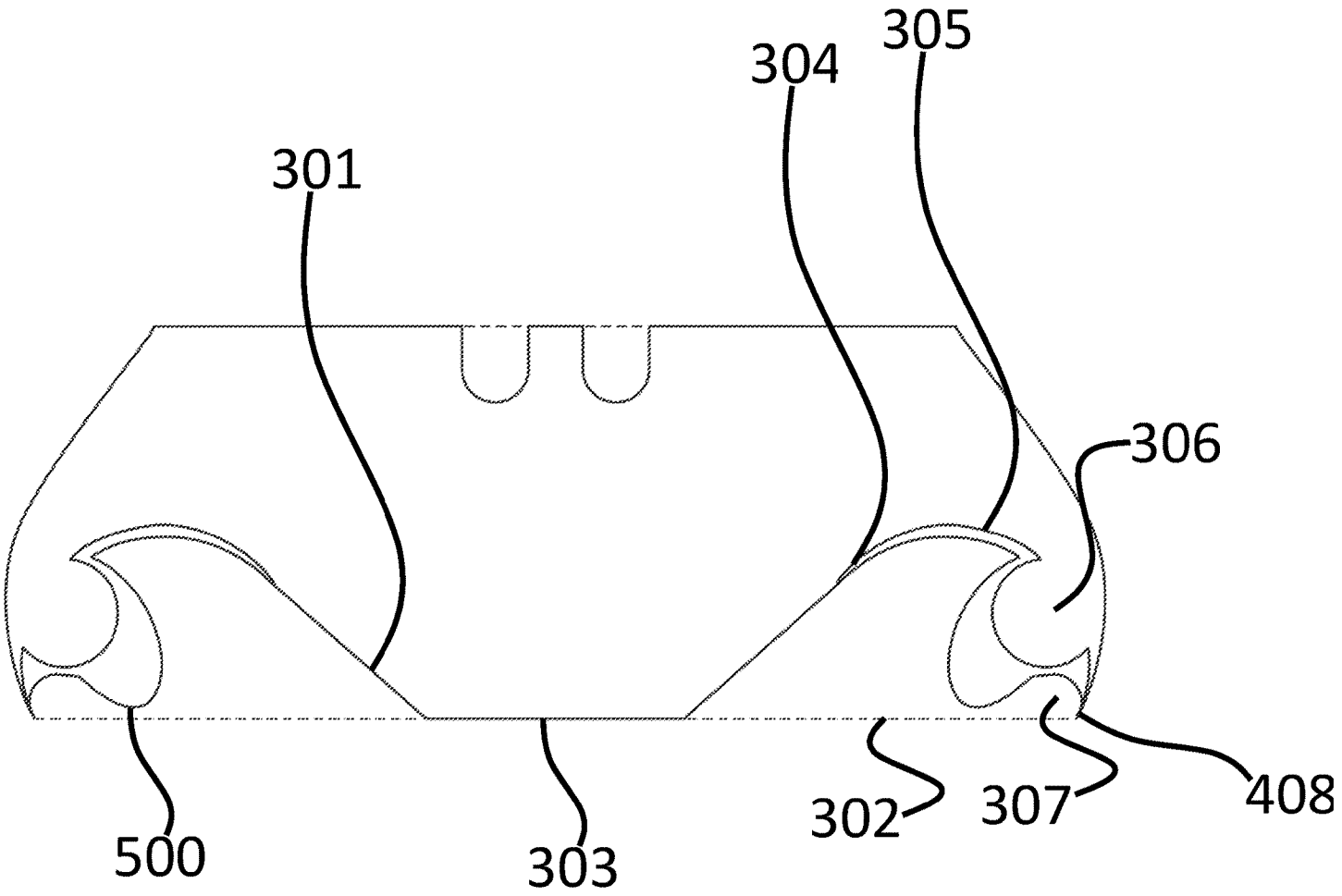
FIG. 6 is a line drawing illustrating hook blade with the addition of a nodule and curvature, which terminates in a point, in accordance with embodiments of the present disclosure.
Figure 7:
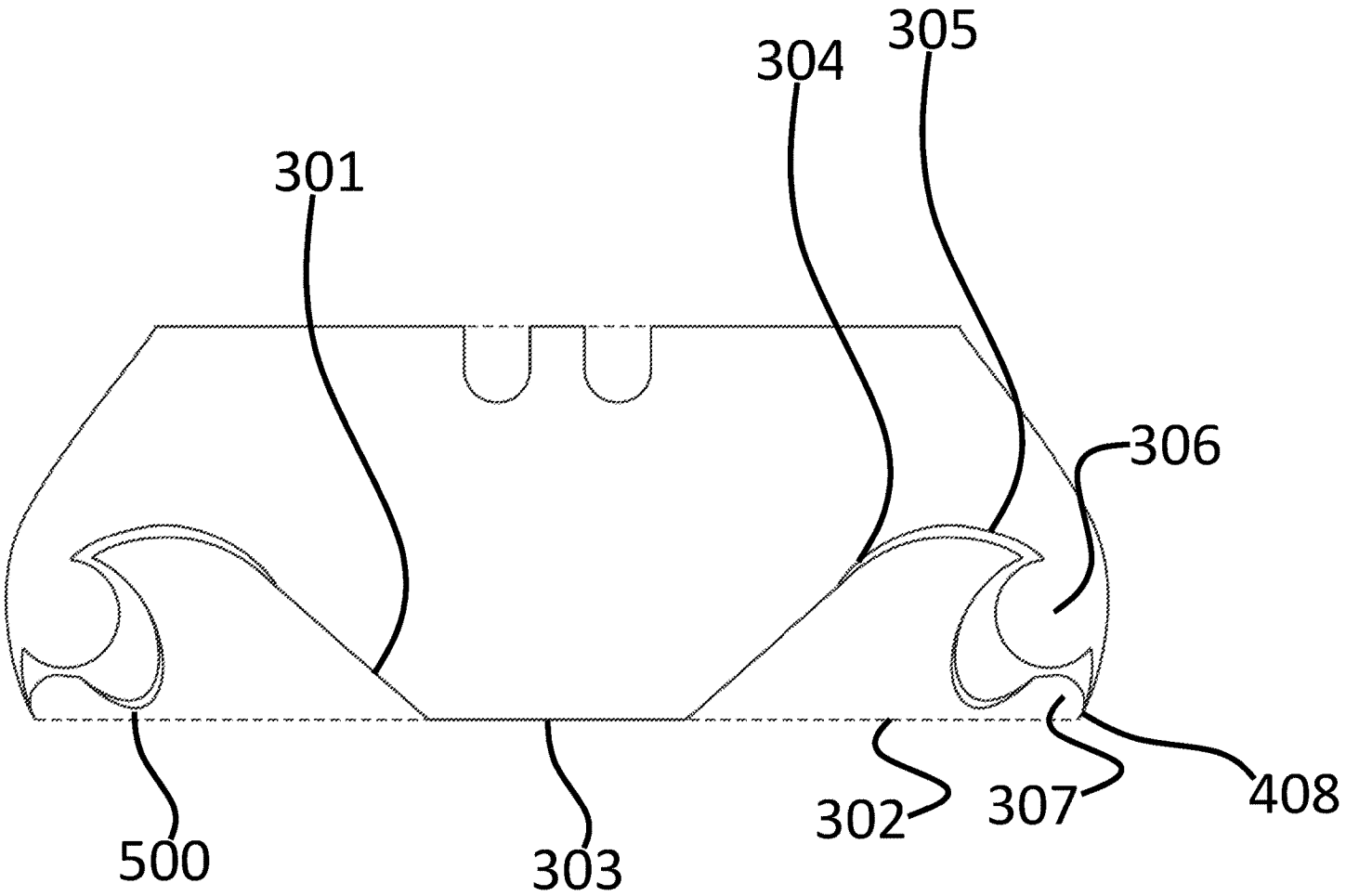
FIG. 7 is a line drawing illustrating hook blade with the addition of a nodule and curvature, which terminates in a point, in accordance with embodiments of the present disclosure.

Now referring to FIGS. 5-7, FIGS. 5-7 disclose a hook blade with a fin 500, which, in embodiments, is sharpened along its edge, extending from the nodule 306 of embodiments. The fin, in embodiments, forms at least a portion of the lower cutting edge 307 and terminates in point 408. This fin serves, in embodiments, as a depth stop, allowing for depth-controlled cutting of roofing materials. In sharpened-fin 500 embodiments, the fin 500 precuts the material before being forced into the lower cutting edge 307 for finish-cutting.

In embodiments, the lower cutting edge 307 formed by the fin 500 and point 408 is substantially U-shaped. In embodiments, the U-shaped lower cutting edge 307 is at least as wide as a typical, three-tab shingle, allowing the shingle edge to be inserted therein during cutting, facilitating the cutting process. In other embodiments, the U-shaped lower cutting edge 307 is wider, allowing wider materials, such as architectural shingles, to be inserted therein. In embodiments, the U-shaped lower cutting edge 307 formed by the fin 500 and point 408 is positioned such that the open portion of the "U" is angled towards the center of the hook blade. In embodiments, this angle is approximately 60 degrees, relative to imaginary line 302. In embodiments, this angle is substantially identical to an angle formed between the inner edge 301 and the imaginary line 302. This feature is especially helpful when cutting products that are in roll form, including tar paper, synthetic underlayment, and self-adhered products and cover materials, such as, TPO, EPDM, and modified bitumen. Whereas the point 208 on a standard hook blade is prone to cutting the underlying rolled product, as there is no way to regulate the blade's depth with the product needing to be unrolled prior to cutting, the U-shaped lower cutting edge 307 formed by the fin 500 and point 408 of embodiments of the present invention allows for cutting of the topmost layer without damaging underlying layers.

In embodiments, the nodule 306 takes on the various shapes depicted by the nodule 306/fin 500 combinations depicted in FIGS. 5-7 without the need for a separate fin 500.

As in previous embodiments, the base 303 of such embodiments transitions into an inner edge 301. The inner edge 301 continues for approximately ⅜", in embodiments, and becomes a sharpened edge 304, which transitions to an arc 305. At a point along the arc 305, the arc 305 transitions into a nodule 306 that extends towards the imaginary line 302 and the inner edge 301, before transitioning into a lower cutting edge 307 that is incident on the original arc 305. The lower cutting edge 307 of embodiments ends in a point 408. The point 408 and the base 303 terminate substantially on the imaginary line 302.

In embodiments, the point along the arc 305 at which the arc 305 transitions into a nodule 306 forms an acute angle, which may assist in cutting certain materials, while, in other embodiments, the angle is a right angle or an obtuse angle, which would tend to be easier to machine.

Now specifically regarding the embodiment depicted in FIG. 5, this embodiment is characterized primarily by the fin 500 being substantially arc-shaped and terminating at imaginary line 302, which corresponds to base 303.

Now specifically regarding the embodiment shown in FIG. 6, this embodiment is characterized primarily by the fin 500 being substantially-oval-shaped, unsharpened, and having a rounded point that terminates above imaginary line 302.

Now specifically regarding the embodiment shown in FIG. 7, this embodiment is characterized primarily by the fin 500 being substantially-oval-shaped, sharpened, and having a rounded point that terminates above imaginary line 302.

The foregoing description of the embodiments of the disclosure has been presented for the purposes of illustration and description. It is not intended to be exhaustive or to limit the disclosure to the precise form disclosed. Many modifications and variations are possible in light of this disclosure. It is intended that the scope of the disclosure be limited not by this detailed description, but rather by the claims appended hereto.

What is claimed is:

1. A blade comprising:

a top edge, a bottom edge located on an opposite side of the blade relative to the top edge, and left and right edges;

a lower cutting edge adjacent said left or right edge;

an upper sharpened edge positioned above said lower cutting edge and adjacent the same edge as said lower cutting edge;

at least one inner edge emanating from said bottom edge and angled towards said top edge; and at least one fin disposed between said lower cutting edge and said upper sharpened edge, wherein said inner edge is tangent to said upper sharpened edge, wherein said lower cutting edge is configured for cutting, and wherein said bottom edge is parallel to and shorter than said top edge.

2. The blade of claim 1 wherein the upper sharpened edge forms a valley configured to capture an asphalt shingle positioned at an interface where the upper sharpened edge and the fin meet.

3. The blade of claim 1 wherein said blade is configured to be retained in a knife.

4. The blade of claim 1 further comprising a U-shaped aperture bounded by an imaginary line of the bottom edge and the lower cutting edge that extends between a terminal point of the lower cutting edge and the point at which the fin and the lower cutting edge meet, wherein the U-shaped aperture is configured to cut and is coplanar with said bottom edge.

5. The blade of claim 4 wherein said lower cutting edge terminates in the terminal point.

6. The blade of claim 5 wherein said U-shaped aperture comprises an open end bounded by said terminal point of said lower cutting edge and a bottom-most surface of said fin and a closed end and wherein said open end of said U-shaped aperture is angled towards a central portion of said blade.

7. The blade of claim 6 wherein said U-shaped aperture is parallel to said inner edge.

8. The blade of claim 6 wherein said U-shaped aperture is angled towards the central portion of said blade at an angle of 60 degrees, relative to said bottom edge.

9. The blade of claim 1 wherein said blade further comprises an additional upper sharpened edge, an additional lower cutting edge, an additional inner edge, and an additional fin.

10. The blade of claim 1 wherein said fin is sharpened and configured to cut.

11. The blade of claim 1 wherein said fin is blunt and configured to serve as a depth-stop by acting as a pivot against a surface to be cut, allowing for depth controlled cutting.

12. A knife comprising:

a blade comprising:

a top edge, a bottom edge located on an opposite side of the blade relative to the top edge, and left and right edges;

a lower cutting edge adjacent said left or right edge;

an upper sharpened edge positioned above said lower cutting edge and adjacent the same edge as said lower cutting edge;

at least one inner edge emanating from said bottom edge and angled towards said top edge; and at least one fin disposed between said lower cutting edge and said upper sharpened edge, wherein said inner edge is tangent to said upper sharpened edge, wherein said lower cutting edge is configured for cutting and terminates in a terminal point, wherein said bottom edge is parallel to and shorter than said top edge, and wherein at least said upper sharpened edge is arc-shaped.

13. The knife of claim 12 wherein the upper sharpened edge forms a valley configured to capture an asphalt shingle positioned at an interface where the upper sharpened edge and the fin meet.

14. The knife of claim 12 further comprising a U-shaped aperture bounded by an imaginary line of the bottom edge and the lower cutting edge that extends between the terminal point of the lower cutting edge and the point at which the fin and the lower cutting edge meet, wherein the U-shaped aperture is configured to cut and is coplanar with said bottom edge.

15. The knife of claim 14 wherein said U-shaped aperture comprises an open end bounded by said terminal point of said lower cutting edge and a bottom-most surface of said fin and a closed end and wherein said open end of said U-shaped aperture is angled towards a central portion of said blade.

16. The knife of claim 15 wherein said U-shaped aperture is parallel to said inner edge.

17. The knife of claim 15 wherein said fin is sharpened and configured to cut.

18. The knife of claim 15 wherein said fin is blunt and configured to serve as a depth-stop by acting as a pivot against a surface to be cut, allowing for depth controlled cutting.

19. The knife of claim 12 wherein said blade is removable from the knife and wherein said top edge of said blade further comprises two, centrally disposed, u-shaped apertures configured to allow the blade to be retained in the knife.

20. A blade comprising:

a top edge, a bottom edge located on an opposite side of the blade relative to the top edge, and left and right edges;

a lower cutting edge adjacent said left or right edge;

an upper sharpened edge positioned above said lower cutting edge and adjacent the same edge as said lower cutting edge;

at least one inner edge emanating from said bottom edge and angled towards said top edge; and at least one fin disposed between said lower cutting edge and said upper sharpened edge, wherein said inner edge is tangent to said upper sharpened edge, wherein said lower cutting edge and said upper sharpened edge are configured for cutting, wherein said bottom edge is parallel to and shorter than said top edge, wherein at least said upper sharpened edge is arc-shaped, and wherein said upper sharpened edge, said lower cutting edge, and said fin form a continuous cutting edge.

* * * * *